United States Patent [19]

Kanao

[11] Patent Number: 4,548,560

[45] Date of Patent: Oct. 22, 1985

[54] SEAL SYSTEM IN ROTARY ENGINE

[76] Inventor: Mitsuhiro Kanao, Yakeyama-cho 2156-14, Kure-shi, Hiroshima-ken, 737, Japan

[21] Appl. No.: 515,319

[22] Filed: Jul. 19, 1983

[30] Foreign Application Priority Data

Jul. 23, 1982 [JP] Japan ..... 57-129377

[51] Int. Cl.[4] ..... F01C 19/04; F01C 19/08; F02B 53/04

[52] U.S. Cl. ..... 418/144; 418/88; 418/95; 418/146; 418/148; 123/231

[58] Field of Search ..... 418/88, 95, 144, 146–148; 123/231; 277/3, DIG. 1

[56] References Cited

U.S. PATENT DOCUMENTS

| | | | |
|---|---|---|---|
| 917,165 | 4/1909 | Sella | 123/231 |
| 2,044,873 | 6/1936 | Beust | 418/148 |
| 2,148,070 | 2/1939 | Gregg | 418/95 |
| 2,179,401 | 11/1939 | Chkliar | 123/231 |
| 2,458,620 | 1/1949 | Megeber | 418/147 |
| 3,375,015 | 3/1968 | Swearingen | 277/3 |
| 3,514,232 | 5/1970 | Mitchell et al. | 418/147 |
| 3,745,979 | 7/1973 | Williams | 123/231 |
| 3,749,532 | 7/1973 | Privee et al. | 418/148 |
| 3,781,147 | 12/1973 | Sato | 418/88 |
| 3,951,112 | 4/1976 | Hunter | 418/147 |

FOREIGN PATENT DOCUMENTS

| | | | |
|---|---|---|---|
| 2940039 | 4/1981 | Fed. Rep. of Germany | 277/3 |
| 589504 | 3/1959 | Italy | 418/147 |
| 270270 | 7/1928 | United Kingdom | 277/3 |

*Primary Examiner*—John J. Vrablik

*Attorney, Agent, or Firm*—Flynn, Thiel, Boutell & Tanis

[57] ABSTRACT

A seal system in a rotary engine includes apex seals held against an inner peripheral wall surface of a rotor housing, seal rings disposed between the apex seals and a side wall surface of the rotor housing, seal rings disposed between sliding plates mounted on a rotor and the side housing member, a split seal ring disposed between the side housing member and the rotor, and an air seal unit for supplying a flow of compressed air across a clearance between the rotor and the rotor housing to prevent gas leakage between compression and combustion stroke chambers.

4 Claims, 6 Drawing Figures

SEAL SYSTEM IN ROTARY ENGINE

BACKGROUND OF THE INVENTION

The present invention relates to a seal system for use in a rotary engine having partitions or apex seals held in sliding contact with the inner surface of a rotor housing.

Rotary engines known widely as Wankel engines have a seal system including apex seals slidable against the inner wall surface of a rotor housing. Since the apex seals are held in substantial point-to-point contact with the rotor housing inner surface, they fail to provide a sufficient degree of airtight seal and are difficult to maintain an oil film on the rotor housing inner surface, requiring a large amount of lubricating oil to be supplied to the housing surface for preventing seizure. With such a lubricating requirement, an increased quantity of lubricating oil is scraped off the rotor housing by the apex seals and discharged through an exhaust port. The rotor housing wall surface needs to be coated with a hard plated layer of chromium to avoid chatter marks which would otherwise be formed on the rotor housing wall surface. There have been proposed no rotary engines employing sliding plates as seals. Such rotary engines would be widely different in construction from the Wankel engine, and would require a seal system of a substantially totally new arrangement.

The seals are pressed against the inner surface of the rotor housing under resilient forces acting on the rear surfaces of the seals from a gas introduced under pressure in spaces defined in the rotor behind the seals. The gas pressure on the rear surfaces of the seals is offset by a gas pressure acting on the sealing surfaces of the seals. Therefore, the sealing effect attained by such seals is achieved only by a weak force tending to press the seals against the rotor housing surface dependent on the gas pressure applied.

SUMMARY OF THE INVENTION

It is an object of the present invention to provide a seal system for use in rotary engines which is composed of seals highly resistant to thermal expansion and contraction of engine parts due to rapid temperature changes and also resistant to rapid pressure variations at the time of fuel combustion in the engine.

According to the present invention, a seal system in a rotary engine comprises a rotor housing having an elliptical inner wall surface, a rotor rotatably disposed in the rotor housing, a sliding plate supported on the rotor and having a recess defined in a distal end thereof, a two-lobe cam mounted on the rotor housing for enabling the slide plate to move along the elliptical inner wall, and an apex seal inserted between the recess and the elliptical inner wall surface and having a first arcuate surface of a first radius of curvature slidably held against the elliptical inner wall surface and a second arcuate surface of a second radius of curvature different from the first radius of curvature and slidably and rockably received in the recess.

A seal system further according to the invention comprises a rotor housing having an inner wall surface and a side wall, a rotor rotatably disposed in the rotor housing, a sliding plate supported on the rotor, an apex seal supported on the sliding plate and slidably held against the inner wall surface, the apex seal having a first substantially frustoconical recess defined in an end thereof and including a first slant surface, a first substantially frustoconical split ring fitted complementarily in the first recess and capable of being pressed against the side wall of the rotor housing under a gas pressure acting on the first split ring through the first slant surface, the sliding plate having a second substantially frustoconical recess defined in an end thereof and including a second slant surface, and a second substantially frustoconical split ring fitted complementarily in the second recess and capable of being pressed against the side wall of the rotor housing under a gas pressure acting on the second split ring through the second slant surface.

Further according to the invention, a seal system in a rotary engine includes a rotor housing including a side housing member having a circular groove, a rotor rotatably disposed in the rotor housing, a split ring disposed in the circular groove and having a gap, and a split pipe extending radially through the split ring at the gap for expanding the split ring radially outwardly to provide a seal against the side housing member and a seal against the gap, the split ring having a compressed gas pressure slot and a combusted gas pressure slot, the side housing member having a compressed gas entry port and a combusted gas entry port for introducing a gas pressure into the compressed gas pressure slot and the combusted gas pressure slot, respectively, to lift the split ring in a direction out of the circular groove and press the split ring against the rotor.

Still according to the present invention, a seal system in a rotary engine comprises a rotor housing having an inner periphreal wall, a rotor rotatably disposed in the rotor housing and dividing an interior of the rotor housing into a compression stroke chamber and a combustion stroke chamber with a clearance left therebetween, and an air seal unit for supplying a flow of compressed air across the clearance to prevent any gas leakage between the compression and combustion stroke chambers.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
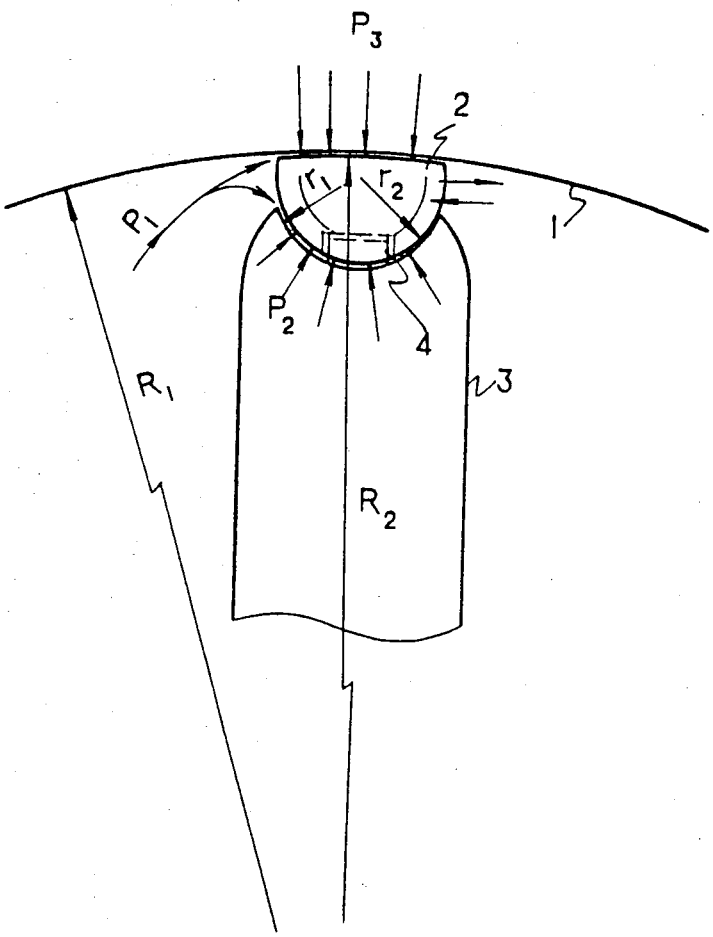
FIG. 1 is a schematic diagram showing the principles of operation of an apex seal according to the present invention.

As shown in FIG. 1, an apex seal 2 has a sliding surface having a radius of curvature $R_2$ which is substantially the same as a largest radius of curvature $R_1$ of the inner surface of a rotor housing 1, thereby allowing the sliding surface of the apex seal 2 to be held in face-to-face sliding contact with the inner surface of the rotor housing 1. The apex seal 2 is supported on a sliding plate 3 having a round recess of a radius of curvature $r_1$, the apex seal 2 having a round surface of a radius of curvature $r_2$ which is substantially the same as the radius of curvature $r_1$. The apex seal 2 is snugly fitted in the round recess in the sliding plate 3 and disposed between the inner surface of the rotor housing 1 and the sliding plate 3. In operation, the apex seal 2 is slid against the inner surface of the rotor housing 1 while at the same time making small back-and-forth movements including slight rocking motions in the round recess in the sliding plate 3.

The principles of operation of the apex seal 2 will be described with reference to FIG. 1. The apex seal 2 is normally biased against the inner surface of the rotor housing 1 by a leaf spring 4 acting between the sliding plate 3 and the apex seal 2. A gas pressure $P_1$ acting on the apex seal 2 is divided into a gas pressure $P_2$ built up between the apex seal 2 and the sliding plate 3 and acting on the round surface of the apex seal 2 and a gas pressure $P_3$ built up between the apex seal 2 and the inner surface of the rotor housing 1 and acting on the sliding surface of the apex seal 2. Since the apex seal 2 is urged by the leaf spring 4 toward the inner peripheral wall of the rotor housing 1, the clearance between the round surface of the apex seal 2 and the sliding plate 3 is greater than the clearance between the sliding surface of the apex seal 2 and the inner peripheral wall of the rotor housing 1. Therefore, the gas flowing through the former clearance tends to pass at a lower speed and the gas pressure $P_2$ becomes higher, and the gas flowing through the latter clearance tends to pass at a higher speed and the pressure $P_3$ becomes lower. For this reason, the gas pressure $P_2$ is greater than the gas pressure $P_3$ at all times, and the apex seal 2 is pressed at its sliding surface against the inner surface of the rotor housing 1 under a weak force dependent on the gas pressure difference $P_2-P_3=Px$. This relatively weak face-to-face pressure sliding contact between the apex seal 2 and the inner surface of the rotor housing 1 allows a suitable oil film to be formed on the inner surface of the rotor housing 1 upon supply of lubricating oil.

To enable the apex seal 2 and the sliding plate 3 to operate with an appropriate clearance left therebetween, there is required a two-lobe cam 5 (FIGS. 2 and 3) for defining the path of movement of the sliding plate 3. The two-lobe cam 5 has an outer profile defined by a fulcrum 6 of the sliding plate 3 which moves along the inner surface of the rotor housing 1 that has an elliptical shape, as shown in FIG. 2.

Figure 2:
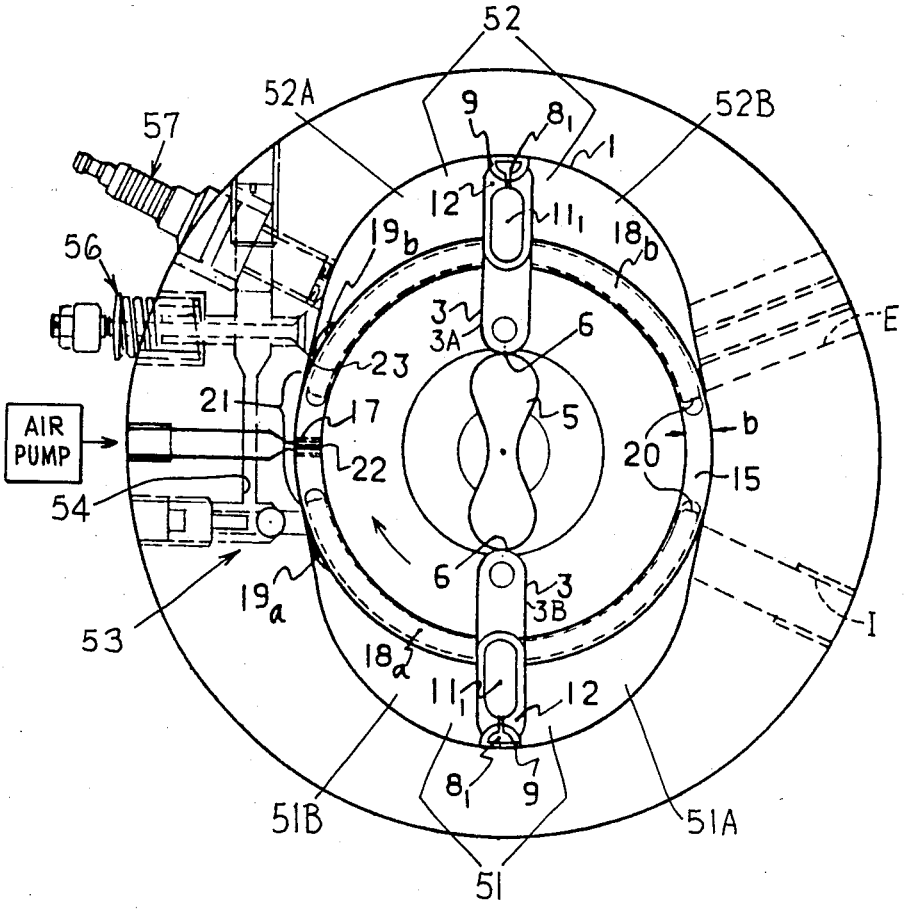
FIG. 2 is a front elevational view, with parts omitted, of a rotary engine incorporating a seal system of the present invention.
Figure 3:
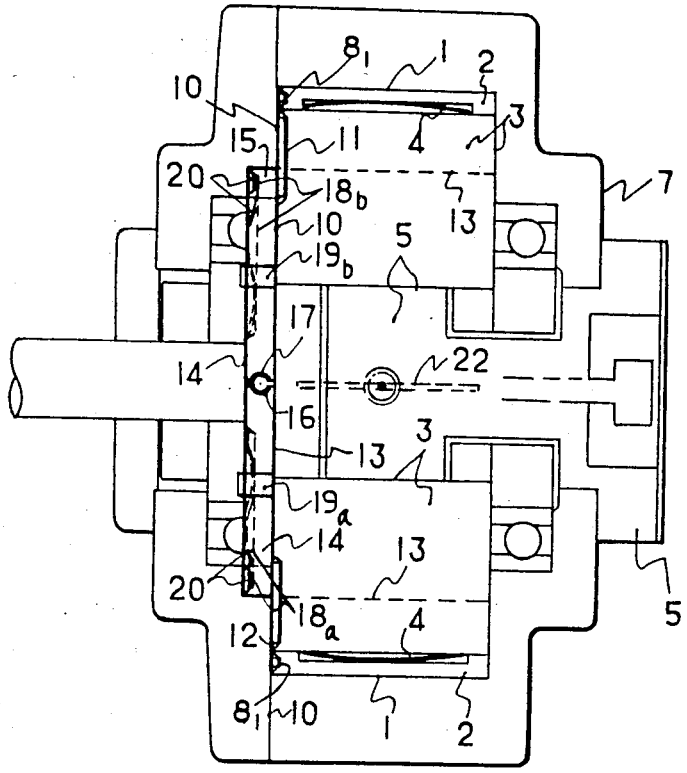
FIG. 3 is a side elevational view of the rotary engine shown in FIG. 2.

In a rotary engine as shown in FIGS. 2 and 3, two apex seals 2 are mounted on two sliding plates 3 disposed in diametrically opposite relation to each other across the two-lobe cam 5. The two-lobe cam 5 is mounted in alignment with an output shaft of the rotary engine and fixed centrally to a side housing member 7 of the rotor housing 1 which is remote from the engine output shaft.

Figure 5:
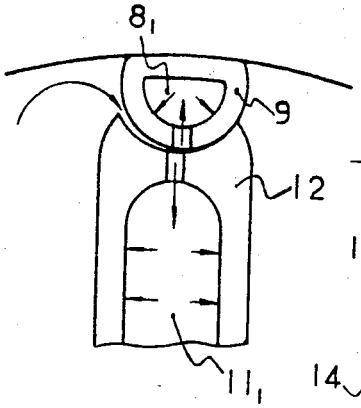
FIG. 5 is a fragmentary enlarged front elevational view of a seal in the engine of FIG. 2.
Figure 4:
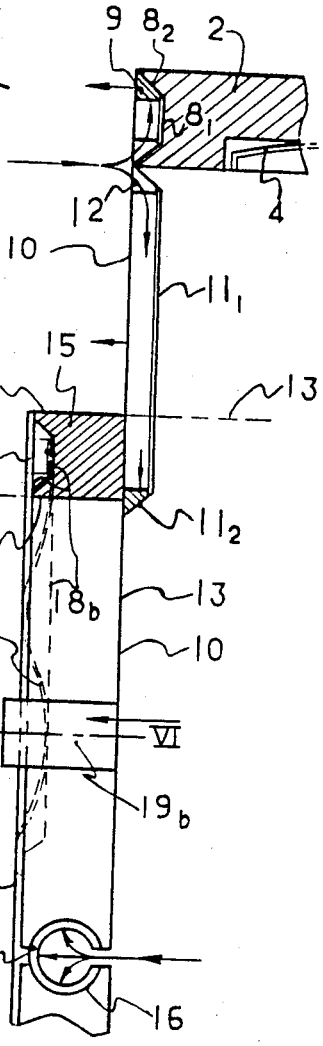
FIG. 4 is a fragmentary enlarged cross-sectional view illustrating seals in the engine of FIG. 3.

Each apex seal 2 has a frustoconical recess $8_1$ defined in one of its axial ends, the frustoconical recess $8_1$ having a contour similar to the profile of the apex seal 2 as shown in FIG. 5. A frustoconical split ring 9 complementary in shape to the recess $8_1$ is fitted therein and acts its own spring force against a slant surface $8_2$ of the frustoconical recess $8_1$ so as to be pressed lightly against the inner wall surface of a side housing member 10 of the rotor housing 1. A gas pressure generated within the engine during operation thereof enters through a gap of the split ring 9 into a space therein and acts on the split ring 9 to provide a seal between the sliding surface of the split ring 9 and the wall surface of the side housing member 10, as shown in FIGS. 4 and 5 in which gas flows are indicated by the arrows.

Likewise, each sliding plate 3 has a U-shaped frustoconical recess $11_1$ defined in one of its axis sides, there being a U-shaped frustoconical ring 12 fitted in the recess $11_1$. The ring 12 is resiliently urged against the inner wall surface of the side housing member 10 under the spring force of the ring 12 acting through a slant surface $11_2$ on the sliding plate 3.

Figure 6:
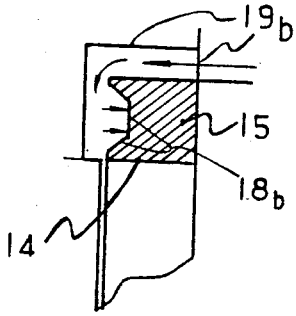
FIG. 6 is an enlarged cross-sectional view taken along line VI—VI of FIG. 4.

As illustrated in FIG. 2, the rotor housing 1 accommodates therein a rotor 13 rotatably mounted therein. The side housing member 10 has a circular groove 14 of rectangular cross section having an outside diameter which is substantially the same as the outside diameter of the rotor 13. A split ring 15 is fitted in the circular groove 14 and has an outside diameter slightly smaller than that of the rotor 13 so that dynamic sealing can effectively be provided when the split ring 15 is pushed toward the side housing member 10 by the thermal expansion of the rotor 13 during operation of the engine. The split ring 15 has a gap where there is defined a radial hole 16 accommodating therein a split pipe 17. The split pipe 17 has a length such that it is slidably fitted in the ring groove 14 having a width b. The split pipe 17 serves to expand the split ring 15 radially outwardly under the resilient force of the split pipe 17 and also provides a seal in the gap of the split ring 15. The split ring 15 has a pair of arcuate gas pressure slots **18*a*, 18*b* having a trapezoidal cross section defined in the side surface thereof facing the side housing member 10. A gas is introduced through gas entry ports 19*a*, 19*b* in the side housing member 10 into the gas pressure slots 18*a*, 18*b* in the directions of the arrows shown in FIG. 6 for thereby lifting the split rings 15 to provide a side seal against the rotor 13**.

A pair of leaf springs 20 is disposed in the gas pressure slots **18*a*, 18*b*, respectively, for pressing the split ring 15 against the rotor side wall at all times under a weak force and permitting the gas pressure to be introduced into the gas pressure slots 18*a*, 18*b* behind the split ring 15. The gas entry ports 19*a*, 19*b* are positioned at different angular positions so as to serve to introduce a compressed gas and a combusted gas, respectively, in compression and combustion strokes. The gas pressure slots 18*a*, 18*b* serve to be supplied with a compressed gas and a combusted gas, respectively, from the corresponding gas entry ports 19*a*, 19*b*. More specifically, the rotor housing 1 has an interior space divided by the rotor 13 and the apex seals 2 into a compression stroke chamber and a combustion stroke chamber. In the compression stroke, the compressed gas is introduced from the compression stroke chamber through the gas entry port 19*a* into the gas pressure slot 18*a*, and in the combustion stroke, the combusted gas is introduced from the combustion stroke chamber through the gas entry port 19*b* into the gas pressure slot 18*b*. The gas pressure slot 18*a* extends arcuately into a region on the side of an intake stroke, and the gas pressure slot 18*b* extends arcuately into a region on the side of an exhaust stroke, the extended portions of the slots 18*a*, 18*b* having closed ends located closely to each other for enabling the split ring 15 to provide an effective side seal against the rotor 13 in all of intake, compression, combustion, and exhaust strokes. The compression and combustion stroke chambers (at 51 and 52 in FIG. 2) defined between the rotor housing 1 and the rotor 13 are separated from each other by a partition area 21 composed of as small a clearance as possible to avoid any adverse effects on the engine operation. However, a certain amount of gas leakage is expected through such a clearance 21. The pressures generated in the compression and combustion stroke chambers are partly offset by each other through the clearance 21. Any high gas pressure resulting from the fuel combustion and leaking into the compression stroke chamber is not harmful to the operation of the engine. However, a leakage of an air-fuel mixture into the combustion stroke chamber at the final period of the compression stroke tends to form an unburned exhaust gas component. To cope with this, it is desirable to provide a suitable seal for preventing such an air-fuel mixture leakage. One proposal would be a mechanical seal provided in the partition area 21. Alternate sliding engagement of the apex seals and the mechanical seal with the rotor housing would cause a noise problem. The mechanical seal is also disadvantageous in that it would cause a large mechanical loss due to pressed engagement with the outer peripheral surface of the rotor 13. It is preferable therefore to employ an air seal having no mechanical elements. More specifically, the partition area 21 has a groove 22 (FIGS. 2 and 3) such for example as a V-shaped groove for supplying compressed air having a pressure on the order of 6 $kg/cm_2$ from a separate pump (not shown) continuously or intermittently dependent on stroke pressure conditions into the partition area 21 across the clearance thereof for preventing an air-fuel mixture from flowing into the combustion stroke chamber at the final period of the compression stroke. Such compressed air is fed into a narrow gap 23 where combustion conditions are poor between the rotor housing wall surface and the rotor 13 to reduce unburned fuel and improve the combustion efficiency through the supply of oxygen. Even when no air is supplied into the groove 22**, the latter serves as a labyrinth packing.

The combustion cycle of the disclosed engine is conventional and not a part of the present invention, but it is apparent from FIG. 2 that a given sliding plate 3 in its lower position divides the compression chamber 51 into a working fluid induction space 51A and compression space 51B and in its upper position divides the combustion chamber 52 into a combustion space 52A and exhaust space 52B. Thus, as one sliding plate 3A rotates clockwise through its FIG. 2 upper position it forces ahead of it through exhaust space 52B and out exhaust port E the combustion products from a first working fluid charge, while being pressed clockwise by expansion of a burning second working fluid charge behind it in combustion space 52A. Simultaneously, the other sliding plate 3B rotates through its lower position of FIG. 2 compresses a third working fluid charge ahead of it in compression space 51B and through the check valve 53 into the reservoir 54, while pulling a fourth working fluid charge into induction chamber 51A from inlet I. After clockwise rotation of the latter (other) sliding plate 3B upward into the combustion chamber 52 and past the valve 56 and spark plug 57, the latter respectively open to flow the compressed third working fluid charge from the reservoir 54 into the combustion space 52A and fire same. The burning, expanding gases push the latter (other) sliding plate 3B clockwise past the FIG. 2 upper sliding plate position to complete a 180° rotor rotation and start a new combustion cycle.

Although a certain preferred embodiment has been shown and described, it should be understood that many changes and modifications may be made therein without departing from the scope of the appended claims.

What is claimed is:

1. A seal system in a rotary engine, comprising a rotor housing having an inner wall surface and a side wall, a rotor rotatably disposed in said rotor housing, a sliding plate supported on said rotor, an apex seal supported on said sliding plate and slidably held against said inner wall surface, said apex seal having a first substantially frustoconical recess defined in an end thereof and including a first slant surface, a first substantially frustoconical split ring fitted complementarily in said first recess and capable of being pressed against said side wall of said rotor housing under a gas pressure acting on said first split ring through said first slant surface, said sliding plate having a second substantially frustoconical recess defined in an end thereof and including a second slant surface, and a second substantially frustoconical split ring fitted complementarily in said second recess and capable of being pressed against said side wall of said rotor housing under a gas pressure acting on said second split ring through said second slant surface.

2. A seal system according to claim 1, wherein said first and second split rings have gaps through which said gap pressure can be introduced into spaces in said first and second split rings.

3. A seal system in a rotary engine, comprising a rotor housing including a side housing member having a circular groove, a rotor rotatably disposed in said rotor housing, a split ring disposed in said circular groove and having a gap, and a split pipe extending radially through said split ring at said gap for expanding said split ring radially outwardly to provide a seal against said side housing member and a seal against said gap, said split ring having a compressed gas pressure slot and a combusted gas pressure slot, said side housing member having a compressed gas entry port and a combusted gas entry port for introducing a gas pressure into said compressed gas pressure slot and said combusted gas pressure slot, respectively, to lift said split ring in a direction out of said circular groove and press said split ring against said rotor.

4. A seal system according to claim 3, including leaf springs disposed in said compressed and combusted gas pressure slots, respectively, for urging said split ring against said rotor.

* * * * *